United States Patent [19]

Watson et al.

[11] Patent Number: 4,926,927

[45] Date of Patent: May 22, 1990

[54] VERTICAL SUBSTRATE ORIENTATION FOR GAS-ATOMIZING SPRAY-DEPOSITION APPARATUS

[75] Inventors: Gary W. Watson, Cheshire; Harvey P. Cheskis, North Haven; Ashok Sankaranarayanan, Bethany, all of Conn.

[73] Assignee: Olin Corporation, New Haven, Conn.

[21] Appl. No.: 246,704

[22] Filed: Sep. 20, 1988

[51] Int. Cl.[5] ..... B22D 23/00; B22D 11/06; C23C 4/12

[52] U.S. Cl. ..... 164/429; 164/46

[58] Field of Search ..... 164/46, 429; 427/422, 427/423; 118/302

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,608,615 | 9/1971 | Conlon | 164/87 |
| 3,727,672 | 4/1973 | Grenfell . | |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 4,512,384 | 4/1985 | Sendzimir | 164/46 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | |
|---|---|---|
| 0225732 | 6/1987 | European Pat. Off. . |
| 0225080 | 10/1987 | European Pat. Off. . |
| 1379261 | 2/1975 | United Kingdom . |
| 1472939 | 5/1977 | United Kingdom . |
| 2007129 | 5/1979 | United Kingdom . |
| 1548616 | 7/1979 | United Kingdom . |
| 1599392 | 9/1981 | United Kingdom . |
| 2172827 | 10/1986 | United Kingdom . |
| 2172900 | 10/1986 | United Kingdom . |

OTHER PUBLICATIONS

R. W. Evans et al, "The Osprey Preform Process", 1985, pp. 13–20 *Powder Metallurgy*, vol. 28, No. 1.

A. G. Leatham et al, "The Osprey Process for the Production of Spray-Deposited Roll, Disc, Tube and Billet Preforms", 1985, pp. 157–173, *Modern Developments in Powder Metallurgy*, vols. 15–17.

*Primary Examiner*—Kuang Y. Lin

*Attorney, Agent, or Firm*—H. Samuel Kieser

[57] ABSTRACT

A molten metal gas-atomizing spray-depositing apparatus has an atomizer employing a pressurized gas flow for atomizing a stream of molten metal into a divergent spray pattern of metal particles and producing a flow of the particles in the pattern thereof along with the gas flow in a generally downward direction. The apparatus also includes a substrate movable continuously along an endless path and having an area thereon disposed below the atomizer for receiving a deposit of the particles in the spray pattern to form a product on the substrate being substantially uniform in thickness. The endless path of the substrate is generally elongated in the downward direction and thus extends parallel to the general downward direction of gas flow such that any particle overspray past the deposit-receiving area is carried by the gas flow downward past the substrate, substantially avoiding entrainment of the particle overspray in the product being formed on the substrate. The spray pattern has a central vertical axis and the substrate has a pair of parallel runs which extend generally parallel to the vertical axis of the spray pattern.

7 Claims, 2 Drawing Sheets

VERTICAL SUBSTRATE ORIENTATION FOR GAS-ATOMIZING SPRAY-DEPOSITION APPARATUS

BACKGROUND OF THE INVENTION

1. Field of the Invention

The present invention generally relates to spray-deposited production of a product on a moving substrate and, more particularly, is concerned with a vertical orientation of the substrate for minimizing recirculation of overspray.

2. Description of the Prior Art

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R. W. Evans et al, *Powder Metallurgy*, Vol. 28, No. 1 (1985), pages 13–20 and "The Osprey Process for the Production of Spray-Deposited Roll, Disc, Tube and Billet Preforms" by A. G. Leatham et al, *Modern Developments in Powder Metallurgy*, Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in European Pat. Appln. No. 225,080. For producing these products, a horizontal substrate or collector system, such as a flat substrate or an endless belt, is moved continuously through the spray to receive a deposit of uniform thickness across its width.

A potential problem associated with employment of the Osprey process for strip production using a horizontal substrate system is entrainment of overspray particles in the product. These solidified droplets and/or splats are undesirable since they can produce voids, oxide inclusions, etc., resulting in unacceptable product quality. Entrainment of overspray is a consequence of secondary gas flows in the spray chamber which can recirculate overspray particles upwardly back into the atomizer region.

Ideally, gas flow should allow overspray particles to fall directly to the bottom of the spray chamber where they cannot be recirculated. However, in strip production using the horizontal substrate system, gas flow is such that secondary vortices above the strip are difficult to avoid and so incorporation can readily occur.

Therefore, a need exists for an approach for reducing the overspray recirculation problem in order to improve the quality of strip product produced by the above-described Osprey spray-deposition process.

SUMMARY OF THE INVENTION

The present invention provides a substrate orientation designed to satisfy the aforementioned needs. The moving substrate disposed in vertical orientation or configuration can significantly minimize the potential for entraining overspray by permitting more efficient gas flow. In this orientation of the substrate, overspray particles are directed by a streamlined gas flow toward an exhaust port at the bottom of the spray chamber instead of being recirculated upwardly toward the atomizer region at the top of the chamber.

Accordingly, the present invention is directed to a molten metal gas-atomizing spray-depositing apparatus. The apparatus includes the combination of: (a) means employing a pressurized gas flow for atomizing a stream of molten metal into a spray pattern of metal particles and producing a flow of the particles in the pattern thereof along with the gas flow in a generally downward direction; and (b) means movable continuously along an endless path and having an area thereon disposed below the atomizing means for receiving a deposit of the particles flowing in the spray pattern to form a product thereon. The endless path of the movable means being generally elongated in the downward direction and thus extends parallel to the general downward direction of gas flow such that any particle overspray past the deposit-receiving area is carried by the gas flow downward past the movable means, substantially avoiding entrainment of the particle overspray in the product being formed thereon.

More particularly, the movable means is an endless substrate having a pair of parallel runs movable about the elongated endless path and thereby extending in the downward direction parallel to the direction of gas flow. The spray pattern has a central vertical axis and the pair of parallel runs are displaced below and on opposite sides of the vertical axis of spray pattern and extend generally parallel thereto.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Prior Art Spray-Deposition Apparatus

Figure 1:
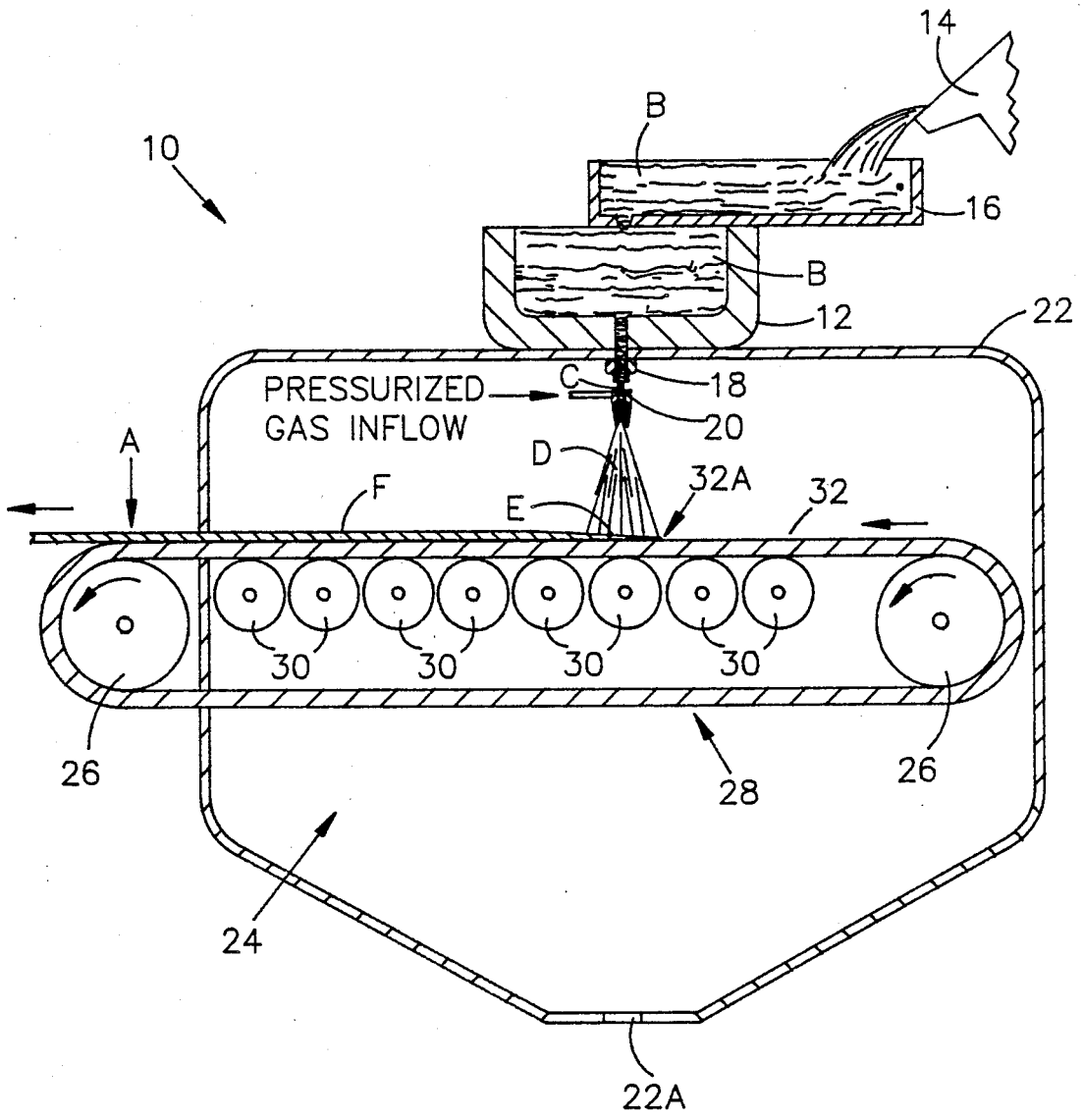
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

Also, a gas atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles, broadcasting downwardly from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A.

The atomizing gas flowing from the atomizer 20 is much cooler than the solidus temperature of the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown).

Modifications of the Present Invention

A fraction of the particles overspray the substrate 28 but ideally will fall to the bottom of the spray chamber 22 where they along with the atomizing gas flow from the chamber via an exhaust port 22A. However, the horizontal orientation of the moving substrate 28 tends to obstruct the natural pattern of gas flow from the atomizer 20 so as to create secondary gas flow vortices above the strip which promote entrainment of overspray particles in the strip product A being formed on the substrate.

Figure 2:
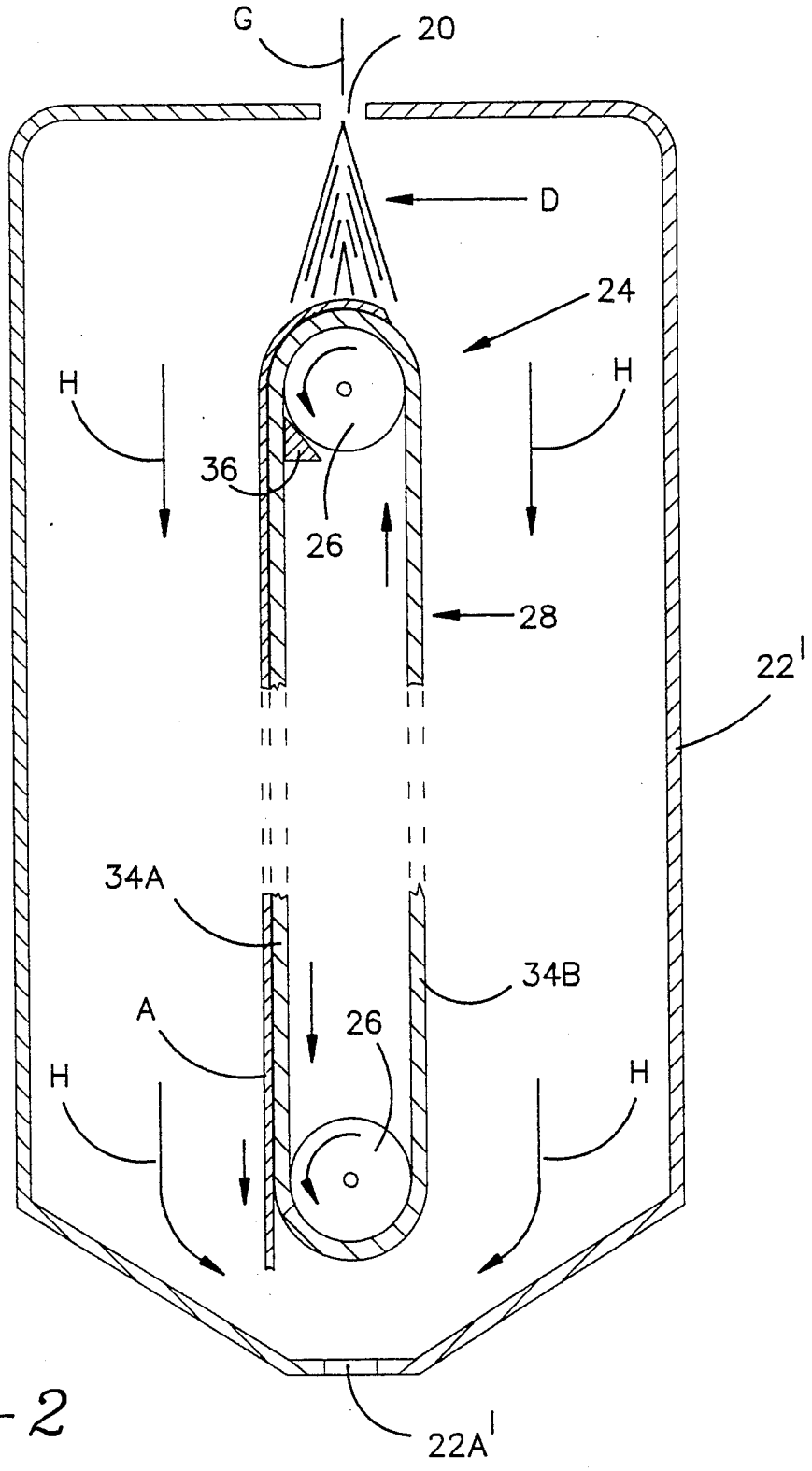
FIG. 2 is a schematic sectional view of the spray-deposition apparatus substrate modified to a vertical orientation in accordance with the principles of the present invention.

The solution of the present invention to the overspray particle entrainment problem is to modify the orientation of the continuous substrate system 24 of the apparatus 10, as depicted in FIG. 2. After modification of the substrate system 24 in accordance with the principles of the present invention, the drive rolls 26 are spaced vertically one above the other and the endless substrate 28 extends between and about them in a vertical orientation or configuration in which spaced parallel runs 34A, 34B of the substrate extend generally parallel to a central vertical axis G of the divergent spray pattern D. The metal particles in the spray D now form the deposit E on the substrate 28 at the area thereof passing over the upper one of the rolls 26. A wedge 36 may be positioned between the upper roller and the inside surface of the substrate 28 to straighten the substrate and strip as it leaves the upper roller 26.

Such substrate orientation can significantly minimize the potential for entrainment of particle overspray by permitting more efficient gas flow. In the vertical orientation of the substrate 28, overspray particles are now directed by the natural streamlined flow of gas, as represented by arrows H, past the substrate runs 34A, 34B and toward the bottom of the spray chamber 22 instead of being recirculated upwardly toward the atomizer 20 at the top of the chamber. The overspray particles are then immediately extracted from the chamber 22' at the bottom exhaust port 22A' by operation of an exhaust mechanism (not shown).

More particularly, as seen in FIG. 2, the pair of parallel runs 34A, 34B of the substrate 28 which move along an elongated endless path extend in the downward direction parallel to direction of gas flow. The parallel substrate runs 34A, 34B are displaced below and on opposite sides of the vertical axis G of spray pattern D and extend generally parallel thereto. The downward direction of gas flow carries any particle overspray past the substrate 28, substantially avoiding entrainment of the particle overspray in the product being formed on the substrate.

The patents, patent application and publications set forth in this specification are intended to be incorporated by reference herein in their entirety.

While the invention has been described above with reference to a specific embodiment, it is evident that many alterations, modifications, and variations will be apparent to those skilled in the art in light of the foregoing description. Accordingly, it is intended to embrace all such alterations, modifications, and variations as fall within the spirit and broad scope of the appended claims.

We claim:

1. In a molten metal gas-atomizing spray-depositing apparatus, the combination comprising:

(a) means employing a pressurized gas flow for atomizing a stream of molten metal into a spray pattern of metal particles and producing a flow of said particles in said pattern thereof along with the gas flow in a generally downward direction; and (b) means movable continuously along an endless path and having an area thereon disposed below said atomizing means for receiving a deposit of said particles flowing in said spray pattern to form a product thereon, said endless path of said movable means being generally elongated in the downward direction and thus extending parallel to the general downward direction of gas flow such that any particle overspray past said deposit-receiving area is carried by the gas flow downward past said movable means, substantially avoiding entrainment of the particle overspray in the product being formed thereon.

2. The apparatus as recited in claim 1, wherein said movable means is an endless substrate having a pair of parallel runs which are movable about said elongated endless path and extend in the downward direction parallel to the direction of gas flow.

3. The apparatus as recited in claim 1, wherein said spray pattern has a central vertical axis and said movable means is an endless substrate having a pair of parallel runs which are displaced below and on opposite sides of said vertical axis of said spray pattern and extend generally parallel thereto.

4. In a molten metal gas-atomizing spray-depositing apparatus, the combination comprising:

(a) means employing a pressurized gas flow for atomizing a stream of molten metal into a spray pattern of metal particles and producing a flow of said particles in said pattern thereof along with the gas flow in a generally downward direction; and (b) a substrate system including an endless substrate movable continuously along an endless path and having an area thereon disposed below said atomizing means for receiving a deposit of said particles flowing in said spray pattern to form a product on said substrate;

(c) said endless path of said substrate being generally elongated in the downward direction and thus extending parallel to the general downward direction of gas flow such that any particle overspray past said deposit-receiving area is carried by the gas flow downward past said substrate, substantially avoiding entrainment of the particle overspray in the product being formed thereon;

(d) said spray pattern having a central vertical axis and said substrate having a pair of spaced apart runs which are movable about said endless path and extend generally in the downward direction of said gas flow.

5. The apparatus as recited in claim 4, wherein said runs of said substrate are disposed generally parallel to one another and displaced below and on opposite sides of said vertical axis of said spray pattern and extend generally parallel thereto.

6. The apparatus as recited in claim 4, wherein said substrate system includes a pair of rolls spaced one above the other in alignment with said atomizing means, said endless substrate extending about and between said rolls.

7. In a molten metal gas-atomizing spray-depositing apparatus, the combination comprising:

(a) means employing a pressurized gas flow for atomizing a stream of molten metal into a spray pattern of metal particles and producing a flow of said particles in said pattern thereof along with the gas flow in a generally downward direction; and (b) a substrate system including a pair of rolls spaced one above the other in alignment with said atomizing means and an endless substrate extending about and between said rolls and movable continuously along an endless path and having an area thereon disposed below said atomizing means for receiving a deposit of said particles flowing in said spray pattern to form a product on said substrate;

(c) said endless path of said substrate being generally elongated in the downward direction and thus extending parallel to the general downward direction of gas flow such that any particle overspray past said deposit-receiving area is carried by the gas flow downward past said substrate, substantially avoiding entrainment of the particle overspray in the product being formed thereon;

(d) said spray pattern having a central vertical axis and said substrate having a pair of spaced apart runs which are movable about said endless path and extend generally in the downward direction of said gas flow, said runs of said substrate being disposed generally parallel to one another and displaced below and on opposite sides of said vertical axis of said spray pattern and extend generally parallel thereto.

* * * * *

UNITED STATES PATENT AND TRADEMARK OFFICE

CERTIFICATE OF CORRECTION

PATENT NO. : 4,926,927

DATED : May 22, 1990

INVENTOR(S) : W. Gary Watson, Harvey P. Cheskis and Sankaranarayanan Ashok

It is certified that error appears in the above—identified patent and that said Letters Patent is hereby corrected as shown below:

On the title page please delete the following:

[75] Inventors: Gary W. Watson, Cheshire; Harvey P. Cheskis, North Haven; Ashok Sankaranarayanan, Bethany, all of Conn.

and insert the following:

[75] Inventors: W. Gary Watson, Cheshire; Harvey P. Cheskis, North Haven; Sankaranarayanan Ashok, Bethany, all of Conn.

At column 2, line 32, after "avoiding", delete "entrainnent", and insert --entrainment--.

Signed and Sealed this

Eleventh Day of August, 1992

*Attest:*

*Attesting Officer*

DOUGLAS B. COMER

*Acting Commissioner of Patents and Trademarks*